US008322182B2

(12) United States Patent
Haas et al.

(10) Patent No.: US 8,322,182 B2
(45) Date of Patent: Dec. 4, 2012

(54) METHOD FOR PRODUCING A POT-SHAPED HOUSING PART, AND A POT-SHAPED HOUSING PART, ESPECIALLY FOR A HUB PART OF A HYBRID DRIVE

(75) Inventors: Herbert Haas, Oberkirch (DE); Uwe Nestlen, Offenburg (DE)

(73) Assignee: PROGRESS-WERK Oberkirch AG, Oberkirch (DE)

( * ) Notice: Subject to any disclaimer, the term of this patent is extended or adjusted under 35 U.S.C. 154(b) by 272 days.

(21) Appl. No.: 12/699,084

(22) Filed: Feb. 3, 2010

(65) Prior Publication Data

US 2010/0192723 A1 Aug. 5, 2010

Related U.S. Application Data

(63) Continuation of application No. PCT/EP2008/006405, filed on Aug. 4, 2008.

(30) Foreign Application Priority Data

Aug. 6, 2007 (DE) ..... 10 2007 038 784

(51) Int. Cl.
*B21D 22/00* (2006.01)

(52) U.S. Cl. ..... 72/348; 72/365.2

(58) Field of Classification Search ..... 72/83, 348, 72/350, 352, 353.2, 353.6, 356, 365.2
See application file for complete search history.

(56) References Cited

U.S. PATENT DOCUMENTS

| | | | | |
|---|---|---|---|---|
| 4,872,250 | A * | 10/1989 | De Marco | 29/893.3 |
| 5,355,706 | A | 10/1994 | Deriaz et al. | |
| 5,471,858 | A * | 12/1995 | Deriaz | 72/83 |
| 6,045,254 | A * | 4/2000 | Inbar et al. | 366/130 |
| 6,279,278 | B1 * | 8/2001 | Morris et al. | 52/239 |

FOREIGN PATENT DOCUMENTS

| | | | |
|---|---|---|---|
| DE | 39 32 823 | C1 | 12/1990 |
| DE | 43 15 503 | A1 | 1/1994 |
| DE | 198 07 017 | A1 | 3/1999 |
| DE | 100 61 403 | A1 | 6/2002 |
| DE | 103 22 752 | A1 | 12/2004 |
| DE | 10 2005 022 801 | A1 | 11/2006 |
| DE | 100 61 403 | B4 | 12/2007 |
| EP | 0 568 779 | A1 | 11/1993 |
| EP | 0 605 916 | A1 | 7/1994 |

* cited by examiner

*Primary Examiner* — Teresa M Ekiert
(74) *Attorney, Agent, or Firm* — Harness, Dickey & Pierce, P.L.C.

(57) ABSTRACT

A method for producing a pot-shaped housing part, especially for a hub part of a hybrid drive. The housing part has a bottom and a wall extending away from the bottom. An outer face of the wall extends approximately up to an outer face of the bottom, with the outer face of the bottom facing away from a free edge of the wall. The method includes the steps of clamping the radially inner zone of a blank in a workpiece holder, so that a radially outer zone of the blank directly adjoining the radially inner zone is free, and folding the radially outer zone of the blank towards and against a contact surface of the workpiece holder by means of a forming process until the outer face of the radially outer zone extends at least up to and preferably beyond the outer face of the radially inner zone.

6 Claims, 5 Drawing Sheets

METHOD FOR PRODUCING A POT-SHAPED HOUSING PART, AND A POT-SHAPED HOUSING PART, ESPECIALLY FOR A HUB PART OF A HYBRID DRIVE

CROSS REFERENCE TO RELATED APPLICATIONS

The present application is a continuation of pending International patent application PCT/EP2008/006405 filed on Aug. 4, 2008 designating the United States, and which was published in German and claims priority of German patent application No. 10 2007 038 784.0 filed on Aug. 6, 2007. The entire contents of these applications are incorporated herein by reference.

BACKGROUND OF THE INVENTION

The invention relates to a method for producing a pot-shaped housing part, especially for a hub part of a hybrid drive, the housing part having a bottom and a wall extending away from the bottom, and an outer face of the wall extending at least approximately to an outer face of the bottom, which outer face of the bottom faces away from a free edge of the wall.

The invention further relates to such a pot-shaped housing part.

The preferred application of the pot-shaped housing part within the scope of the present invention is its use for a hub part of a hybrid drive.

In the use of such a housing part for a hub part of a hybrid drive, packs of magnets are fastened to the outside of the generally cylindrical wall. In this case the bar-shaped magnets of the magnet packs must extend in their longitudinal direction as far as possible to the outer face of the bottom which faces away from the free edge of the wall.

In order to ensure this, the known hub parts are constructed in at least two parts. A first part has a bottom and a wall extending away from the bottom, the bottom and the wall being connected integrally to one another. The transition to the wall in the radially outer zone of the bottom is rounded, with a relatively large radius, so that the outer face of the wall does not extend up to the outer face of the bottom. In the known hub parts, in order to enable the magnet packs to have a support surface extending to the outer face of the bottom, a cylindrical ring is welded to the outer face of the wall connected to the bottom, the outer face of the ring then forming the support surface for the magnet packs. One of the edges of the ring extends as far as the outer face of the bottom, or even projects somewhat beyond it.

The disadvantage of such a method for producing a hub part consists in increased manufacturing cost, since a pot must first be formed and the ring must be welded to the peripheral wall of the pot. In addition, the housing part has undesirably high weight.

Furthermore, such a hub part for a hybrid drive may typically have a toothing on the inner face of the wall. In the known hub parts this toothing is formed by a further component, specifically by a generally cylindrical ring with internal toothing which is joined to the inner face of the aforementioned ring or to the inner face of the wall of the pot.

In general, the known housing parts, if they additionally have an internal toothing, therefore have a three-part construction, which further increases the manufacturing cost.

SUMMARY OF THE INVENTION

It is an object of the invention to specify a method for producing a pot-shaped housing part which can be carried out at reduced cost.

It is a further object of the invention to specify a pot-shaped housing part, the manufacturing cost of which is reduced.

According to an aspect of the invention, a method for producing a pot-shaped housing part is provided, said housing part having a bottom and a wall extending away from the bottom, and an outer face of the wall extending at least approximately up to an outer face of the bottom, which outer face of the bottom faces away from a free edge of the wall, the method comprising the steps:

providing a plate-shaped blank;

clamping the blank, in a radially inner zone thereof, in a workpiece holder, the radially inner zone forming the bottom of the housing part to be produced, a radially outer zone of the blank which directly adjoins the radially inner zone being free, the radially outer zone forming the wall of the housing part to be produced, and the workpiece holder having a circumferential contact surface;

folding the radially outer zone of the blank towards the contact surface and pressing the radially outer zone against the contact surface in a forming process until a radius of curvature at a transition from an outer face of the radially outer zone to an outer face of the radially inner zone is reduced such that the outer face of the radially outer zone extends at least up to the outer face of the radially inner zone.

According to another aspect of the invention, a method for producing a pot-shaped housing part is provided, said housing part having a bottom and a wall extending away from the bottom, and an outer face of the wall extending at least approximately up to an outer face of the bottom, which outer face of the bottom faces away from a free edge of the wall, comprising the steps:

providing a plate-shaped blank;

clamping the blank, in a radially inner zone thereof, in a workpiece holder, the radially inner zone forming the bottom of the housing part to be produced, a radially outer zone of the blank which directly adjoins the radially inner zone being free, the radially outer zone forming the wall of the housing part to be produced, and the workpiece holder having a circumferential contact surface;

folding the radially outer zone of the blank towards the contact surface and pressing the radially outer zone against the contact surface in a forming process in order to reduce a radius of curvature at a transition from an outer face of the radially outer zone to an outer face of the radially inner zone, the rolling or pressing taking place at least in a direction oriented along the radially outer zone towards the radially inner zone until the outer face of the radially outer zone projects beyond the outer face of the radially inner zone.

According to still another aspect of the invention, a pot-shaped housing part is provided, comprising a bottom, a wall extending away from the bottom, the wall having an outer face extending at least up to an outer face of the bottom, which outer face of the bottom faces away from a free edge of the wall, the wall and the bottom are configured in one piece, wherein the outer face of the wall has a projecting portion projecting beyond the outer face of the bottom, which is produced from material of the wall.

In the production method according to the invention, the pot-shaped housing part is produced in one piece by a forming process from a plate-shaped blank which is configured in the form of a flat plate with or without embossment. The plate-shaped blank, which generally consists of steel, advantageously has a circular shape. The circular blank is clamped in the workpiece holder, specifically in a radially inner zone which later forms the bottom of the finished housing part. The workpiece holder clamps the radially inner zone on two opposite sides of the plate-shaped blank. The radially outer zone which directly adjoins the radially inner zone is then folded in a forming process and pressed against the contact surface of the workpiece holder, the forming preferably being carried out in several stages. By means of the forming process the radially outer zone of the plate-shaped blank is pressed against the contact surface of the workpiece holder until the radius of curvature at the transition from the radially inner zone to the radially outer zone is minimized on the outside, that is, forms a sharp corner or edge. The transition between the radially inner zone and the radially outer zone is therefore filled by the forming process and does not form a reduction in wall thickness, which might cause rupture or fracture. Because the radius of curvature at the transition from the radially inner zone to the radially outer zone is minimized, the outer face of the radially outer zone, which forms the wall of the housing part, extends at least up to the outer face of the radially inner zone which forms the bottom, so that, in the case of use of the housing part for a hub part of a hybrid drive, a support surface extending up to the outer face of the bottom is provided for the magnet packs to be subsequently attached.

With the housing part according to the invention, therefore, it is not necessary to additionally weld a ring to the outside of the wall in order to obtain the desired support surface for the magnet packs.

The housing part according to the invention can be produced at low cost in one piece by a forming process from a plate-shaped blank.

In a preferred configuration of the method, the forming process for folding and pressing the radially outer zone against the contact surface of the workpiece holder comprises a rolling or pressing of the radially outer zone by means of at least one roll or at least one pressing tool.

In particular with the use of rolling, the radially outer zone can be formed and pressed against the contact surface of the workpiece holder with a small requirement for tooling, because the same roll or rolls can be moved along the radially outer zone multiple times and because, with rolling, an appropriate material flow is obtained in the radially outer zone, and rupture or fracture of the radially outer zone during bending and pressing can be very largely ruled out.

In this case it is further preferred that, during rolling, the at least one roll or the at least one pressing tool is moved in a direction which is substantially parallel to the contact surface and is oriented from the radially inner zone to a free edge of the radially outer zone.

In this process it is advantageous that the material of the radially outer zone can flow towards the free edge, whereby the material can flow from the transitional zone between the radially inner zone and the radially outer zone of the blank, without producing a reduction of wall thickness in the transitional zone if the radius of curvature in this zone is reduced to a sharp edge.

In a further preferred configuration of the method the forming is carried out in several stages.

In this case it is advantageous that the folding and pressing to reduce the radius of curvature in the transitional zone between the radially inner zone and the radially outer zone can take place gradually and therefore without excessive stressing of the material, the slow material flow being utilized to prevent rupture or fracture of the material of the blank in the transitional zone between the radially inner zone and the radially outer zone.

In a further preferred configuration of the method, in a following step the radially outer zone continues to be formed in such a manner that the outer face of the radially outer zone extends beyond the outer face of the radially inner zone.

Accordingly, with the housing part according to the invention, the outer face of the wall extends beyond the bottom, the projecting portion being produced from the wall material by forming of the wall.

In this case it is advantageous that, in a likewise cost-effective manner, the pot-shaped housing part can be produced not only in such a manner that the outer face of the wall extends approximately as far as the outer face of the bottom but even extends beyond the outer face of the bottom. It is thereby achieved that, in the case where the housing part is used as a hub part of a hybrid drive, the support surface for the magnet packs to be attached later extends as far as possible to the bottom or even beyond it. Whereas this has been achieved in the known hub parts only by welding on the additional ring, in the case of the method according to the invention this is contrived integrally from the same material of the blank, significantly reducing the cost of the method according to the invention.

In this connection, with the method according to the invention, the further forming comprises a rolling or pressing of the radially outer zone against the contact surface of the workpiece holder, the rolling or pressing also taking place at least in a direction oriented along the radially outer zone towards the radially inner zone.

In this case it is advantageous that material of the radially outer zone is pressed in the direction towards the radially inner zone, this material then forming the desired projecting portion without thinning of the transitional zone between the radially inner zone and the radially outer zone.

In a further preferred configuration of the method, the contact surface of the workpiece holder has a contouring, in particular a toothing, the contouring being impressed into an internal face of the radially outer edge zone during the pressing process.

Accordingly, in the housing part according to the invention a contouring, in particular a toothing, is formed integrally in the wall material on an inner face of the wall.

In this case it is advantageous that the internal toothing mentioned in the introduction, which is usually provided in hub parts for hybrid drives, is also formed integrally with the wall of the housing part, further reducing the manufacturing cost of the housing part according to the invention. It is especially advantageous that the toothing can be impressed in the same shaping process with which the wall of the housing part is formed from the plate-shaped blank, whereby a further manufacturing step is saved in producing the toothing, so that the manufacturing time is also reduced. In the case where the pot-shaped housing part is used for a hub part of a hybrid drive, the separate production and installation of the transmitter ring (toothed ring) is saved.

Further advantages and features are apparent from the following description and the appended drawing.

It is self-evident that the features mentioned hereinbefore and to be explained hereinafter can be used not only in the particular combination specified but also in other combinations or in isolation, without departing from the scope of the present invention.

BRIEF DESCRIPTION OF THE DRAWINGS

Exemplary embodiments of the invention are represented in the drawing and are described in more detail below with reference to the drawing, in which.

DETAILED DESCRIPTION OF PREFERRED EXEMPLARY EMBODIMENTS

Figure 1:
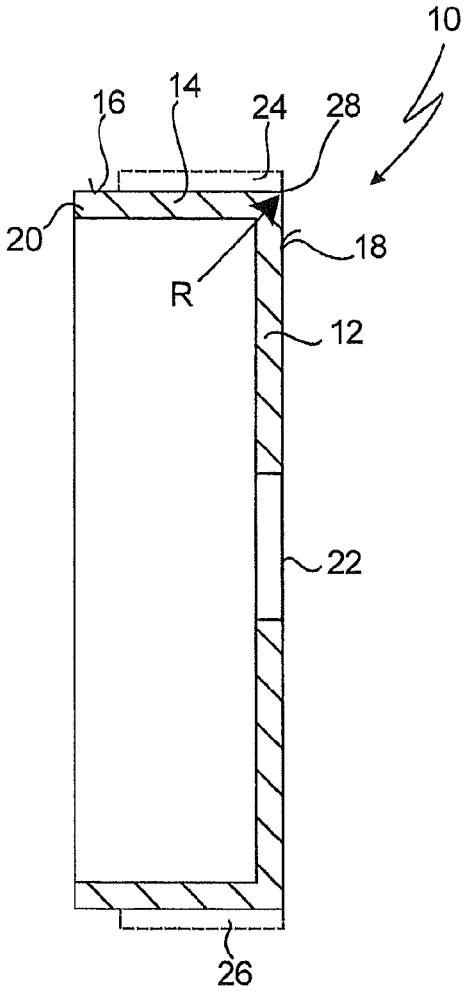
FIG. 1 shows a basic variant of a one-piece pot-shaped housing part according to the invention in a sectional view.
Figure 2:
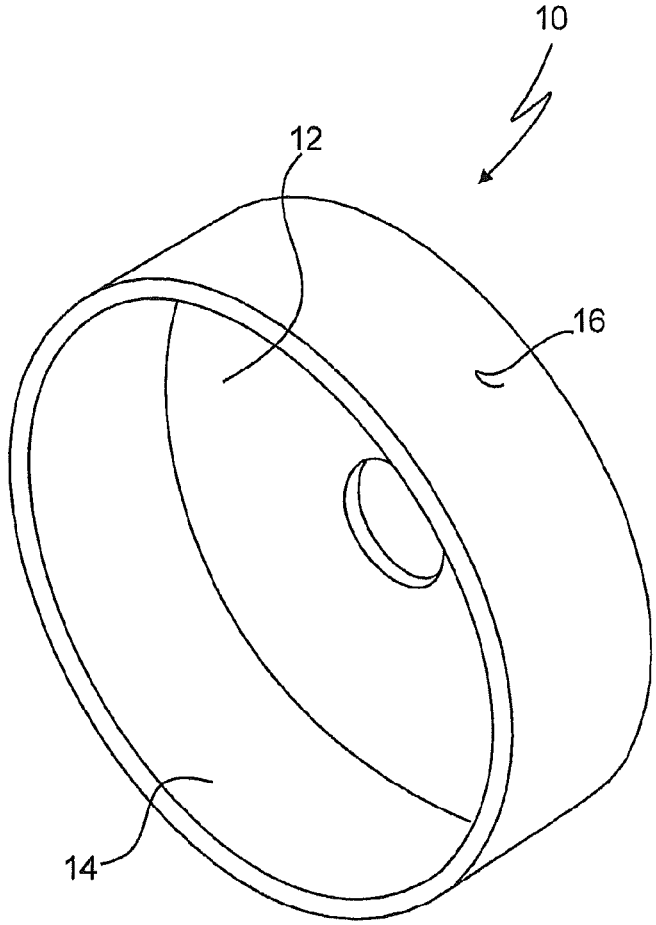
FIG. 2 shows the housing part in FIG. 1 in a perspective view.

FIGS. 1 and 2 show a pot-shaped housing part denoted by the general reference numeral 10. Without restriction of the generality thereof, the housing part 10 is used for a hub of a hybrid drive (not shown).

The housing part 10 has a bottom 12 which generally has the form of a plate with a circular outer periphery.

A wall 14, which generally is cylindrical, extends away from the bottom 12.

The bottom 12 and the wall 14 are configured integrally with one another.

The wall 14 has a circumferential outer face 16 and the bottom 12 has an outer face 18 which faces away from a free edge 20 of the wall 14.

The bottom 12 further has a central bore 22, as is usual with the application of the housing part 10 for a hub part of a hybrid drive.

If the housing part 10 is used for a hub part of a hybrid drive, packs of magnets 24 and 26 are fastened to the outer face 16 of the wall 14, the outer face 16 serving as a support surface for the magnet packs. A multiplicity of such magnets 24, 26 is usually fastened to the outer face 16 of the wall 14, being distributed circumferentially thereon.

The outer face 16 of the wall 14 of the housing part 10 extends at least up to the outer face 18 of the bottom 12. This means that a transition 28 from the wall 14 to the bottom 12 has a very small, sometimes even vanishing, radius of curvature R or, in other words, that the outer face 16 adjoins the outer face 18 as far as possible with a sharp edge, it even being possible for the outer face 16 to have a portion projecting beyond the outer face 18, as will be described later.

With reference to FIGS. 3 to 7 it is described below how the housing part 10 can be produced in a one-piece manner.

Figure 3:
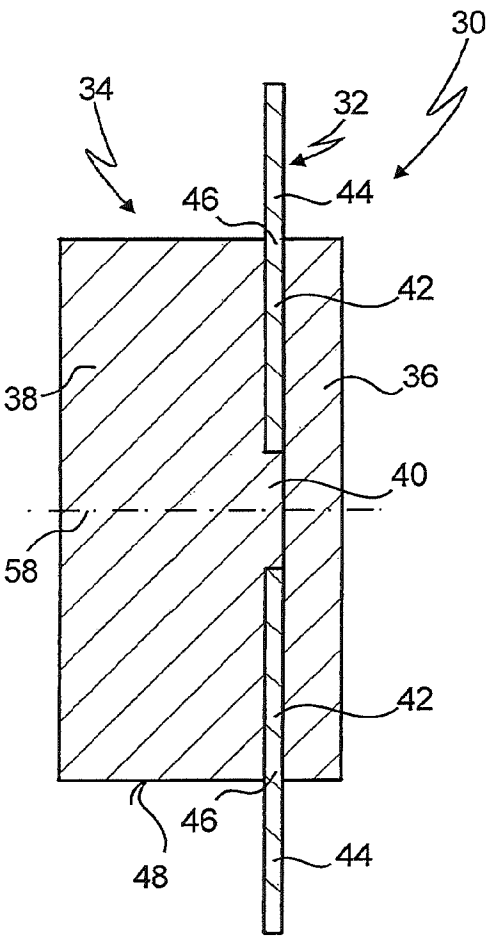
FIG. 3 shows in a sectional representation an apparatus comprising a workpiece holder and a blank, for illustrating a method for producing the housing part in FIGS. 1 and 2, in a first process stage.

FIG. 3 shows, to begin with, an apparatus 30 comprising a blank 32 from which the housing part 16 is produced, and a workpiece holder 34.

The blank 32 is configured in the form of a plate, in particular a circular plate. The blank 32 may have a flat or embossed form.

The workpiece holder 34 comprises a first workpiece holder element 36 and a second workpiece holder element 38, between which the blank 32 is clamped. The blank 32 already has the bore 22 in the bottom 12 of the finished housing part 10, the second workpiece holder element 38 having a projection 40 which engages in the bore, so that the blank 32 is clamped in the workpiece holder 34 in a centered manner.

Only a radially inner zone 42 of the blank 32 is clamped in the workpiece holder 34, while a radially outer zone 44 is free.

The radially inner zone 42 later forms the bottom 12 of the finished housing part 10, while the radially outer zone 44 forms the wall 14.

The radially outer zone 44 directly adjoins the radially inner zone 42 at a point 46. The point 46 later forms approximately the transition 28 between the wall 14 and the bottom 12 of the finished housing part 10.

The workpiece holder 34, or more precisely the second workpiece holder element 38, has a circumferential contact surface 48 which represents a cylindrical surface corresponding to the contour of the wall 14 to be formed.

Figure 4:
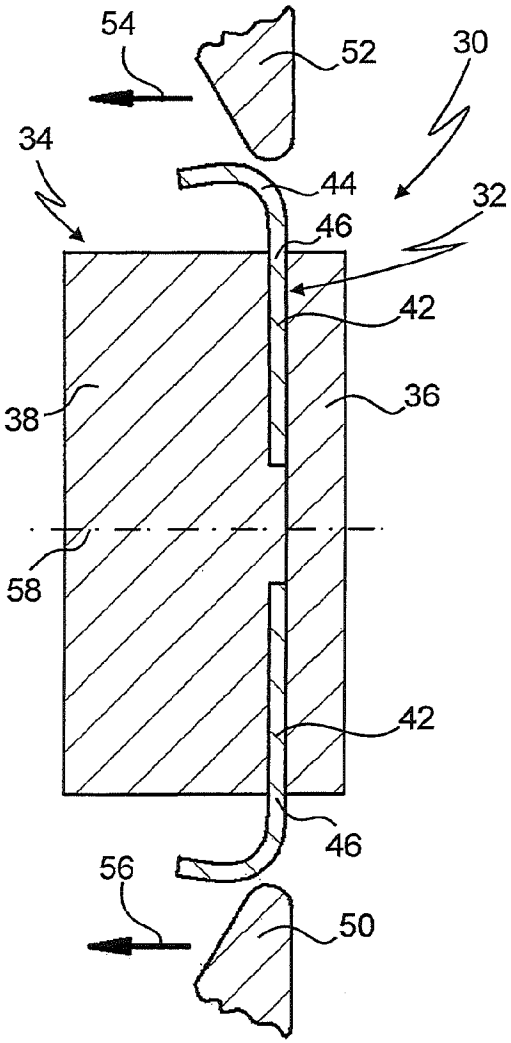
FIG. 4 shows the apparatus in FIG. 3 in a further process stage.

After the plate-shaped blank 32 has been clamped into the workpiece holder 34, as shown in FIG. 3, the radially outer zone 44 of the blank 32 is now folded over by a forming process, specifically against the contact surface 48, as shown in FIG. 4.

Figure 6:
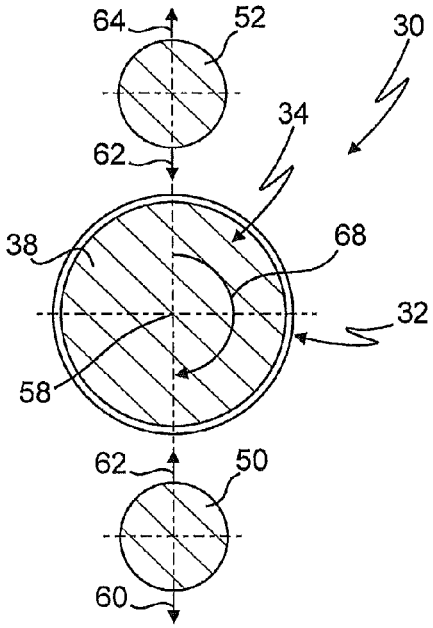
FIG. 6 shows the apparatus of FIGS. 3 to 5 in a top view and in a sectional representation.

The forming of the radially outer zone 44 is effected by means of rolling or pressing. In the exemplary embodiment shown, the apparatus 30 comprises a rolling tool with two rolls 50 and 52. FIG. 6 shows the apparatus 30 in a top view.

The rolls 50 and 52 engage the radially outer zone 44 of the blank 32 and during the rolling process are moved, starting at the level of the radially inner zone 42, in the direction of arrows 54 and 56 which indicate the direction of pressing, whereby the radially outer zone 44 is folded from its originally rectilinear extension towards the contact surface 48 of the workpiece holder 34.

As shown in FIG. 6, the rolls 50 and 52 can be advanced radially with reference to a longitudinal axis 58, as is indicated in FIG. 6 with arrows 60 to 64. During the rolling process, the workpiece holder 34 is rotated about the longitudinal axis 58, as indicated by an arrow 68. As this happens the rolls 50 and 52 press on the radially outer zone 44 in the direction of the arrows 54 and 56, initially, as shown in FIG. 4, still at a relatively large distance from the transition point 46 between the radially outer zone 44 and the radially inner zone 42 of the blank 32, and then with a decreasing distance in further stages (cf. FIGS. 5 and 7).

The forming of the radially outer zone 44 by means of rolling is carried out in several stages, in order to press the radially outer zone 44 gradually against the contact surface 48 of the workpiece holder 34.

The rolls 50 and 52 run in the direction of the arrows 54 and 56 multiple times over the radially outer zone 44, in order to obtain a preliminary/intermediate shape with approximately equal wall thicknesses, to prevent a thinning of material and, finally, to obtain a sharp edge on the outside of the transition from wall to bottom of the pot-shaped housing part 10.

Figure 5:
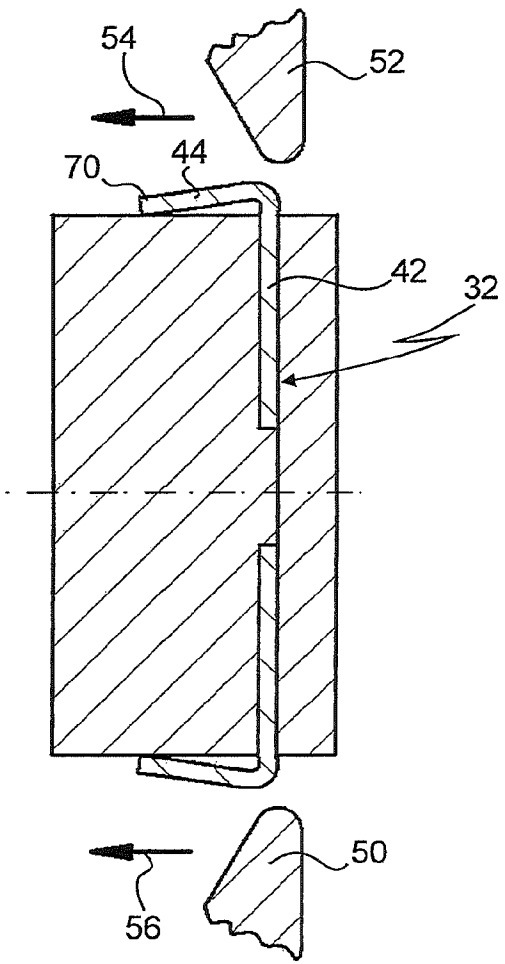
FIG. 5 shows the apparatus in FIGS. 3 and 4 in a further process stage.

Accordingly, FIG. 5 shows a further process stage in which the rolls 50 and 52 have been advanced further towards the longitudinal axis 58, while the direction of pressing, starting from a position at the level of the radially inner zone 42, continues to be oriented towards a free edge 70 of the radially outer zone 44.

Figure 7:
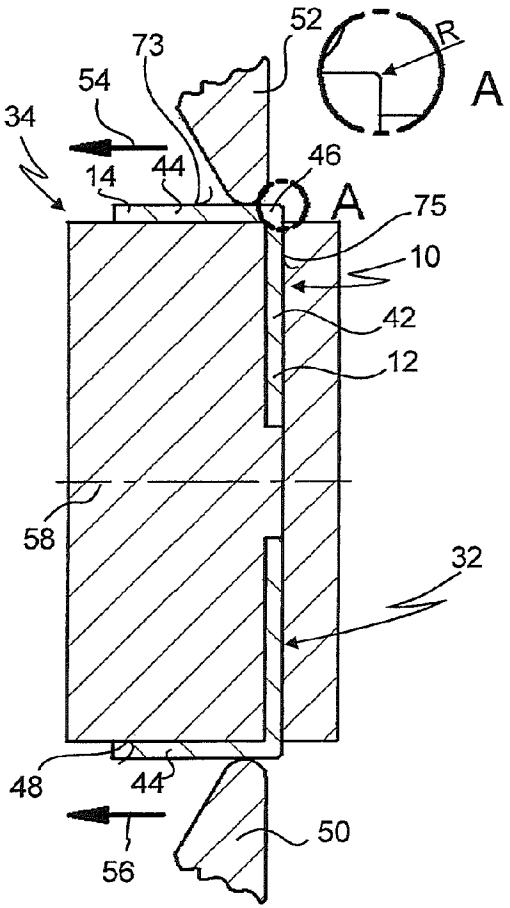
FIG. 7 shows the apparatus in FIGS. 3 to 5 in a further process stage.

The forming is carried out repeatedly, the rolls 50 and 52 being advanced increasingly towards the longitudinal central axis 58, until the state shown in FIG. 7 is reached.

Through the repeated rolling, the radially outer zone 44 is pressed over its full length against the contact surface 48 of the workpiece holder 34, until the radius R has been reduced to a minimum, as shown in FIG. 7, in other words, until the sharp-edged transition 28 of the component 10 in FIG. 1 is reached at the transition point 46 between the radially outer zone 44 and the radially inner zone 42, or until an outer face 73 of the radially outer zone 44 extends at least up to an outer face 75 of the radially inner zone 42. This is shown in the enlarged detail A in FIG. 7.

As is apparent from FIG. 7, the material at the transition point 46 is not depleted or thinned, whereby the wall 14 now formed, which is constituted by the radially outer zone 44, is connected with sufficient material thickness to the radially inner zone 42 which forms the bottom 12 of the housing part 10.

In the process stage in FIG. 7, the housing part 10 is substantially finished, apart from any necessary straightening of the free edge 70, as shown in FIGS. 1 and 2.

For the forming process according to FIG. 7, the apparatus 30 preferably has a third roll 71, the three rolls 50, 52 and 71 being arranged at an angle of 120° to one another.

Figure 8:
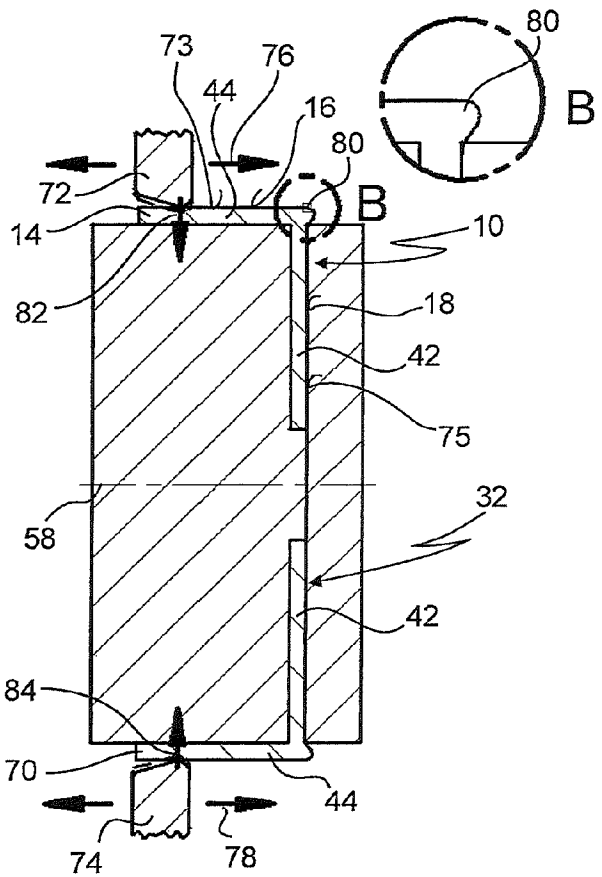
FIG. 8 shows the apparatus of FIGS. 3 to 5 and 7 in a further variant of the method for producing a housing part according to a development of the housing part in FIGS. 1 and 2.

Starting from FIG. 7, the housing part 10 produced up to now may be further formed, as shown in FIG. 8.

With the process stage in FIG. 8 the radially outer zone 44, or the wall 14, is thus formed, in particular by further rolling of the radially outer zone 44 against the contact surface 48 by means of two or more rolls 72, 74, until the outer face 16 or 73 projects beyond the outer face 18 or 75, as is shown in FIG. 8 in the enlarged detail B. In this forming process the rolls 72 and 74 are also moved towards the radially inner zone 42, starting from the free edge 70 of the radially outer zone 44, as is indicated with arrows 76 and 78, so that material of the wall 14 flows in the direction towards the radially inner zone 42, whereby a projecting portion 80 is formed from material of the wall 14.

The projecting portion 80 has thus been produced in one piece from the same blank 32.

During the forming of the radially outer zone 44 by means of rolling, as shown in FIG. 8, the rolls 72 and 74 are also moved radially with respect to the longitudinal axis 58, as is indicated with arrows 82 and 84.

Figure 10:
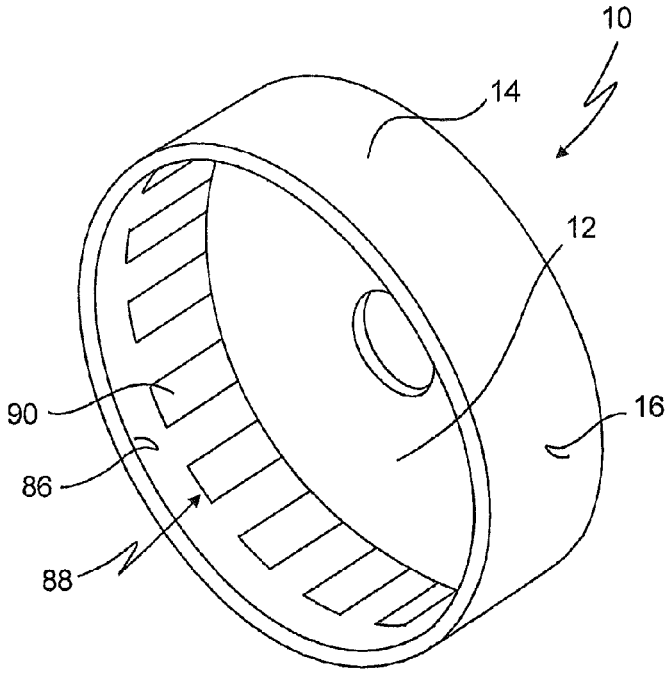
FIG. 10 is a perspective representation of a pot-shaped housing part according to yet a further variant.

FIG. 10 shows yet a further configuration of the housing part 10 which differs from the housing part 10 in FIGS. 1 and 2 in that a contouring 88 is formed integrally in the material of the wall 14 on an inner face 86 of the wall 14.

The contouring 88 consists of a toothing with a plurality of teeth 90 in the form of substantially rectangular relief-like elevations projecting from the inner face 86.

The housing part 10 with the contouring 88 on the inner face 86 of the wall 14 can again be produced in a low-cost manner from the blank 32, as is described with reference to FIGS. 11 and 12.

Up to the process stage shown in FIG. 11, the method is the same as has already been described with reference to FIGS. 3 to 7.

The difference from the method according to FIGS. 3 to 7 is that the contact surface 48 of the workpiece holder 34 has a contouring complementary to the contouring 88; that is, instead of the teeth 90 complementary depressions are correspondingly located in the contact surface 48.

Figure 11:
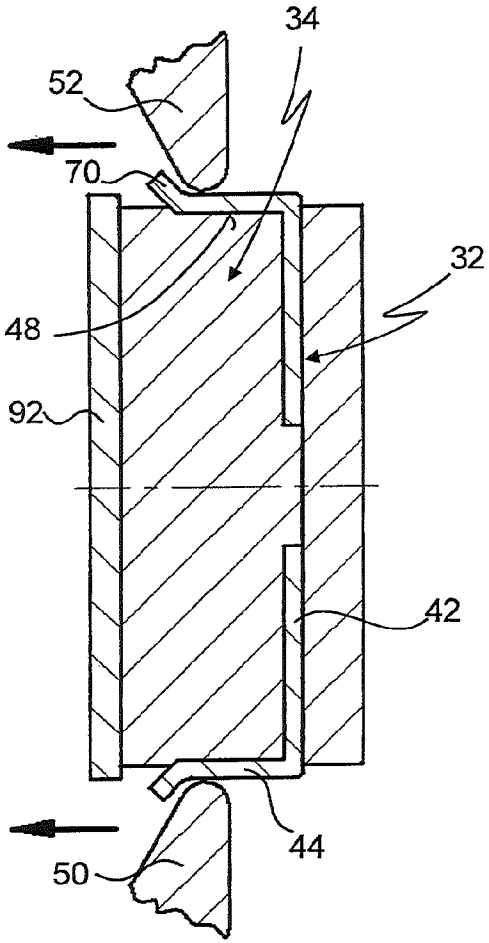
FIG. 11 shows an apparatus comprising a blank and workpiece holder for clarification of a method for producing the housing part in FIG. 10 in a process stage corresponding to FIG. 7.

In the process stage according to FIG. 11 the radially outer zone 44 of the blank 32 is pressed against the contact surface 48 of the workpiece holder 34 in such a manner that the contouring of the contact surface 48 is impressed or indented in the material of the radially outer zone 44.

Figure 12:
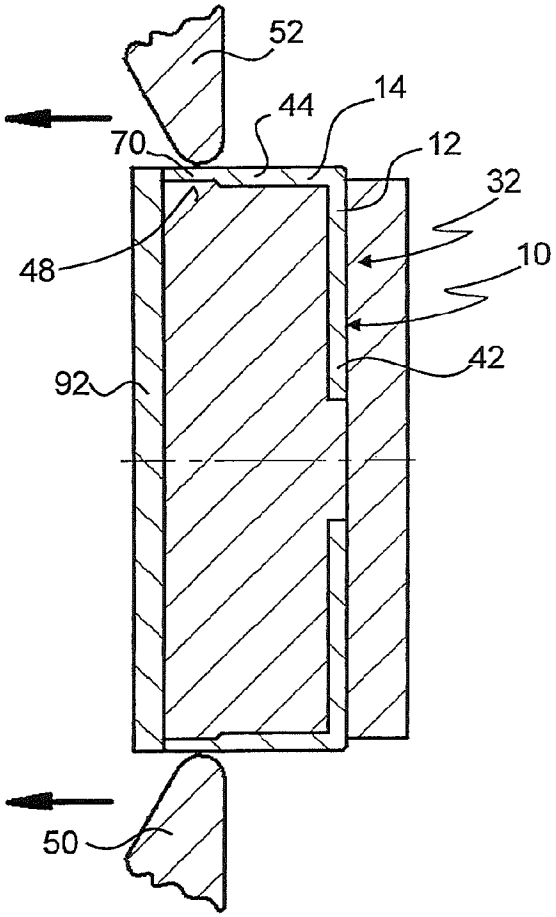
FIG. 12 shows the apparatus in FIG. 11 in a further process stage.

In the last process stage according to FIG. 12, the free edge 70 of the radially outer zone 44, which tends to spread radially outwards during this process, is likewise pressed against the contact surface 48 and thus straightened.

On the workpiece holder 34 there may be provided a closing plate 92 which projects radially beyond the contact surface 48, so that the free edge 70 of the radially outer zone 44 is pressed form-fittingly against the closing plate 92, whereby the free edge 70 is made as straight as possible over its entire periphery and clean and complete forming of the teeth is guaranteed, whereas otherwise the material does not flow into the tool contour.

Although this is not shown in FIG. 12, the housing part 10 with the contouring 88 may have a projecting portion corresponding to the projecting portion 80 in FIG. 8 at the transition point 46 between the wall 14 and the bottom 12, this projecting portion 80 then being formed integrally, following from FIG. 12, through further shaping of the wall 14 or of the radially outer zone 44 as shown in FIG. 8.

Figure 9:
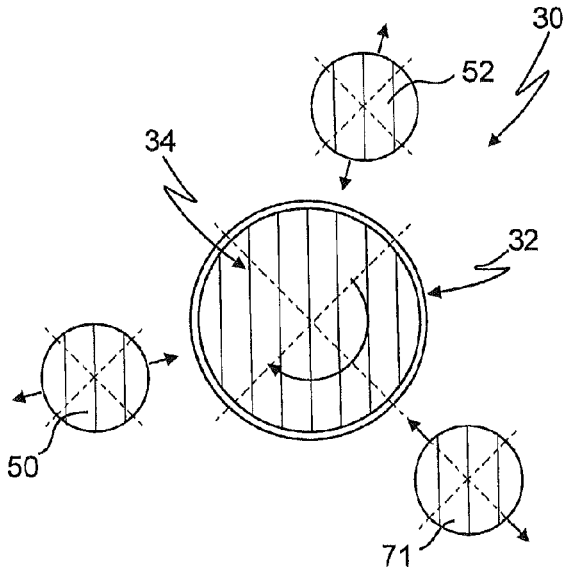
FIG. 9 shows a top view of the apparatus in FIGS. 7 and 8 in a sectional representation.

For the shaping processes according to FIGS. 11 and 12 the apparatus 30 with three rolls according to FIG. 9 is preferably used.

The invention claimed is:

1. A method for producing a pot-shaped housing part defining an axis, said housing part having a bottom and a wall extending axially away from said bottom, and an outer face of said wall extending at least approximately up to an outer face of said bottom, which outer face of said bottom faces away from a free edge of said wall, comprising the steps:

providing a plate-shaped blank;

clamping said blank, in a radially inner zone thereof in a workpiece holder, said radially inner zone forming said bottom of said housing part to be produced, a radially outer zone of said blank which directly adjoins said radially inner zone being free, said radially outer zone forming said wall of said housing part to be produced, and said workpiece holder having a circumferential contact surface;

folding said radially outer zone of said blank towards said contact surface and pressing said radially outer zone against said contact surface in a forming process in order to reduce a radius of curvature at a transition from an outer face of said radially outer zone to an outer face of said radially inner zone, said rolling or pressing taking place at least in an axial direction along said radially outer zone towards said radially inner zone until said outer face of said radially outer zone projects axially beyond said outer face of said radially inner zone.

2. The method of claim 1, wherein said forming process for folding and pressing said radially outer zone against said contact surface of said workpiece holder comprises a rolling or pressing of said radially outer zone by at least one roll or a pressing tool.

3. The method of claim 2, wherein, during said rolling or pressing, said at least one roll or said at least one pressing tool is moved in a direction which is substantially parallel to said contact surface and is oriented from said radially inner zone to a free edge of said radially outer zone.

4. The method of claim 1, wherein said forming process is carried out in several stages.

5. The method of claim 1, wherein said contact surface of said workpiece holder has a contouring, said contouring being impressed into an inner face of said radially outer edge zone as the latter is pressed against said contouring.

6. The method of claim 1, wherein said pot-shaped housing part to be produced is a hub part of a hybrid drive.

* * * * *